US008988288B2

(12) United States Patent
Handro et al.

(10) Patent No.: US 8,988,288 B2
(45) Date of Patent: Mar. 24, 2015

(54) TRI-BAND ANTENNA FOR NONCELLULAR WIRELESS APPLICATIONS

(75) Inventors: Andreas Handro, Münster (DE); Michael Kühn, Bochum (DE); Christopher Wehrmann, Bochum (DE)

(73) Assignee: BlackBerry Limited, Waterloo (CA)

( * ) Notice: Subject to any disclaimer, the term of this patent is extended or adjusted under 35 U.S.C. 154(b) by 154 days.

(21) Appl. No.: 13/547,648

(22) Filed: Jul. 12, 2012

(65) Prior Publication Data

US 2014/0015718 A1 Jan. 16, 2014

(51) Int. Cl.

| | |
|---|---|
| ***H01Q 5/00*** | (2006.01) |
| ***H01Q 9/04*** | (2006.01) |
| ***H01Q 1/24*** | (2006.01) |
| ***H01Q 9/42*** | (2006.01) |

(52) U.S. Cl.

CPC ..... *H01Q 5/0031* (2013.01); *H01Q 5/0058* (2013.01); *H01Q 5/0062* (2013.01); *H01Q 9/42* (2013.01)

USPC ..... 343/700 MS; 343/702

(58) Field of Classification Search

CPC . H01Q 9/0457; H01Q 5/0072; H01Q 5/0068; H01Q 21/28

See application file for complete search history.

(56) References Cited

U.S. PATENT DOCUMENTS

| | | | | |
|---|---|---|---|---|
| 6,559,811 | B1 | 5/2003 | Pulimi et al. | |
| 6,784,843 | B2 * | 8/2004 | Onaka et al. | 343/700 MS |
| 6,795,021 | B2 | 9/2004 | Ngai et al. | |
| 6,975,278 | B2 | 12/2005 | Song et al. | |
| 7,180,467 | B2 | 2/2007 | Fabrega-Sanchez et al. | |
| 7,388,543 | B2 | 6/2008 | Vance | |
| 7,925,319 | B2 | 4/2011 | Kenoun et al. | |
| 8,294,618 | B2 * | 10/2012 | Lee et al. | 343/700 MS |
| 2007/0279285 | A1 * | 12/2007 | Hilgers | 343/700 MS |
| 2008/0246668 | A1 * | 10/2008 | Qi et al. | 343/702 |
| 2009/0273521 | A1 | 11/2009 | Wong et al. | |
| 2009/0289859 | A1 | 11/2009 | Pan | |

(Continued)

FOREIGN PATENT DOCUMENTS

| | | |
|---|---|---|
| EP | 1703587 | 9/2006 |

OTHER PUBLICATIONS

Tang et al "A compact coupled-fed penta-band antenna for mobile phone application" Proceedings of Asia-Pacific Microwave Conference 2010; Dec. 7-10, 2010; pp. 2260-2263.*

(Continued)

*Primary Examiner* — Dameon E Levi
*Assistant Examiner* — Ricardo Magallanes
(74) *Attorney, Agent, or Firm* — Hanley, Flight & Zimmerman LLC

(57) ABSTRACT

A tri-band antenna for noncellular wireless applications is provided. The antenna comprises: a first radiating arm for generating a first resonance in a first frequency band, the first radiating arm further enabled for connection to an antenna tuning circuit; the first radiating arm comprising a capacitive coupling structure; a coupling arm separated by a gap from the first radiating arm; a second radiating arm for generating a second resonance in a second frequency band lower than the first frequency band, the second radiating arm connected to the coupling arm such that the second radiating arm is capacitively coupled to the first radiating arm; and a third radiating arm for generating a third resonance in a third frequency band lower than the second frequency band, the third radiating arm connected to the coupling arm such that the third radiating arm is capacitively coupled to the first radiating arm.

20 Claims, 12 Drawing Sheets

(56) References Cited

U.S. PATENT DOCUMENTS

| | | | |
|---|---|---|---|
| 2010/0328182 | A1 | 12/2010 | Wong et al. |
| 2011/0095949 | A1 | 4/2011 | Wong et al. |
| 2012/0001815 | A1 | 1/2012 | Wong et al. |

OTHER PUBLICATIONS

European Patent Office, "Extended European Search Report", issued in connection with European patent application No. 12176191, Sep. 20, 2012, (5 pages).

United States Patent and Trademark Office, "Non-Final Office Action," issued in connection with U.S. Appl. No. 13/940,071, on Nov. 6, 2013, 19 pages.

United States Patent and Trademark Office, "Final Office Action," issued in connection with U.S. Appl. No. 13/940,071, on Feb. 24, 2014, 9 pages.

United States Patent and Trademark Office, "Advisory Action," issued in connection with U.S. Appl. No. 13/940,071, on May 2, 2014, 11 pages.

* cited by examiner

TRI-BAND ANTENNA FOR NONCELLULAR WIRELESS APPLICATIONS

FIELD

The specification relates generally to antennas, and specifically to a tri-band antenna for non-cellular wireless applications.

BACKGROUND

Current mobile electronic devices, such as smartphones, generally have different antennas implemented to support different types of wireless protocols, such as GPS (Global Positioning System), GLONASS (Globalnaya Navigatsionnaya Sputnikovaya Sistema), WIFI of different types, such as WiFi a, WiFi b. WiFi g and WFi n, as well as Bluetooth™. In other words, each wireless protocol has different bandwidth requirements and current mobile electronic devices have different antennas to support the different bandwidth requirements.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
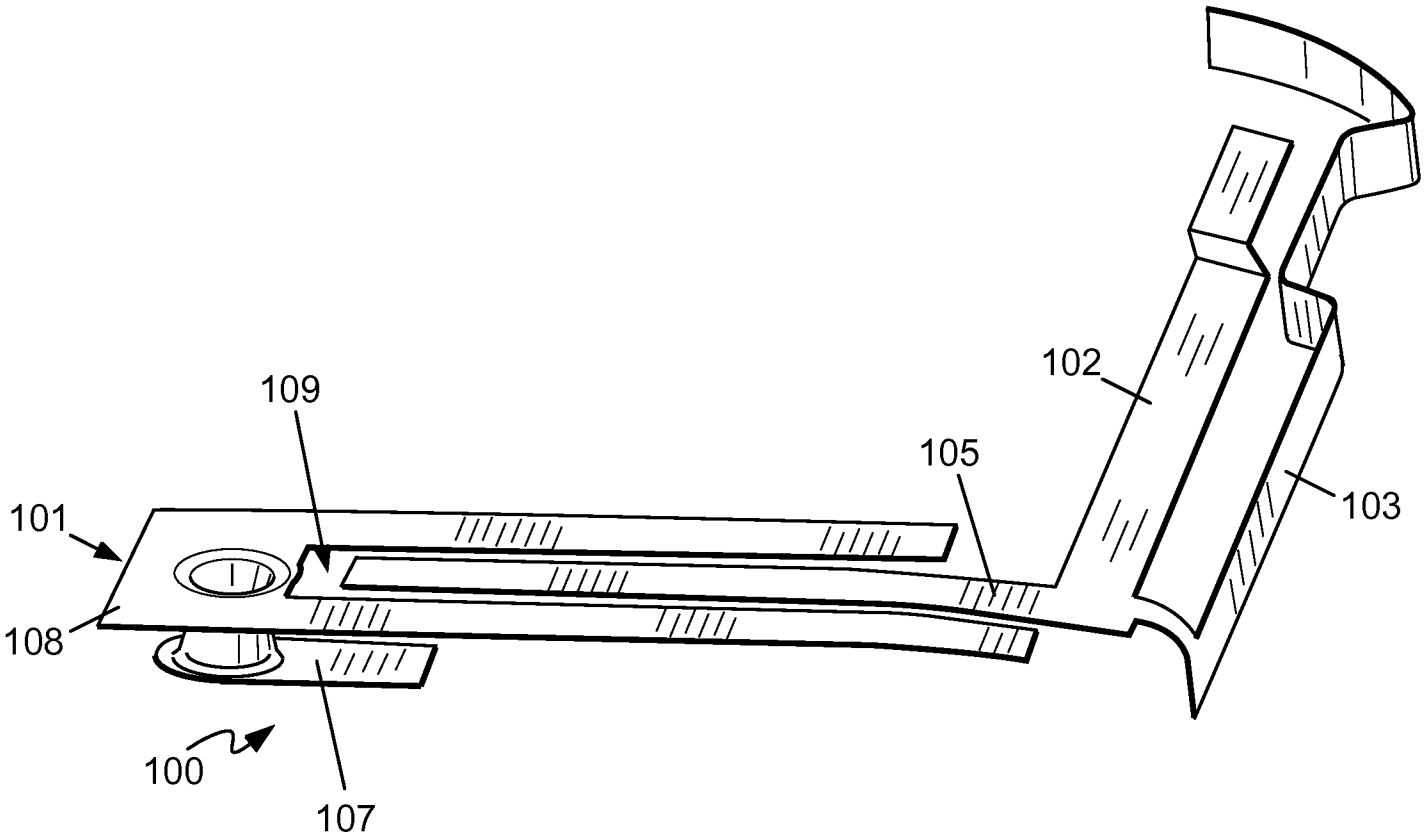
FIG. 1 depicts a left perspective view of a tri-band antenna, according to non-limiting implementations.

An aspect of the specification provides a tri-band antenna comprising: a first radiating arm enabled for generating a first resonance in a first frequency band, the first radiating arm further enabled for connection to an antenna tuning circuit; the first radiating arm comprising a capacitive coupling structure; a coupling arm separated by a gap from the first radiating arm; a second radiating arm enabled for generating a second resonance in a second frequency band lower than the first frequency band, the second radiating arm connected to the coupling arm such that the second radiating arm is capacitively coupled to the first radiating arm; and a third radiating arm enabled for generating a third resonance in a third frequency band lower than the second frequency band, the third radiating arm connected to the coupling arm such that the third radiating arm is capacitively coupled to the first radiating arm.

The first frequency band can comprise one or more of: about 5 GHz to about 6 GHz; and a WiFi a,n band.

The second frequency band can comprise one or more of: about 2 GHz to about 2.5 GHz; and a WiFi b,g band; a Bluetooth™ band.

The third frequency band can comprise one or more of: about 1 GHz to about 2 GHz; and a GPS (Global Positioning System) band; a GLONASS (Globalnaya Navigatsionnaya Sputnikovaya Sistema) band.

The capacitive coupling structure can comprise one of an L-shaped capacitive coupling structure and a U-shaped capacitive coupling structure. The coupling arm one of: extends along a long arm of the L-shaped capacitive coupling structure and ends prior to a short arm of the L-shaped capacitive coupling structure; and, extends between long arms of the U-shaped capacitive coupling structure.

The capacitive coupling structure can comprise a planar structure.

The first radiating arm can comprise one or more of an antenna feed and a contact area for connecting to the antenna tuning circuit. The antenna feed can comprise a three dimensional feed extending from the capacitive coupling structure to the contact area.

At least one of the second radiating arm and the third radiating arm can be adapted to extend along a housing of a mobile electronic device. At least one of the first radiating arm, the second radiating arm and the third radiating arm are located at a position at the housing to reduce combined SAR (specific absorption rate) at the mobile electronic device.

The second radiating arm can be in a same plane as the first radiating arm and the third radiating arm can be in another plane about perpendicular to the same plane.

The second radiating arm and the third radiating arm can be about parallel.

The second radiating arm and the third radiating arm can be about perpendicular to the coupling arm.

The second radiating arm and the third radiating arm can extend in a same direction.

The second radiating arm and the third radiating arm can extend in opposite directions.

The tri-band antenna can further comprise an antenna tuning circuit for independent tuning of each the first frequency band, the second frequency band and the third frequency band, the antenna tuning circuit connected to the antenna feed.

A further aspect of the specification provides a device comprising a housing enabled to house components of the device; a tri-band antenna comprising an antenna feed; a first radiating arm enabled for generating a first resonance in a first frequency band; the first radiating arm comprising a capacitive coupling structure; a coupling arm separated by a gap from the first radiating arm; a second radiating arm enabled for generating a second resonance in a second frequency band lower than the first frequency band, the second radiating arm connected to the coupling arm such that the second radiating arm is capacitively coupled to the first radiating arm; and a third radiating arm enabled for generating a third resonance in a third frequency band lower than the second frequency band, the third radiating arm connected to the coupling arm such that the third radiating arm is capacitively coupled to the first radiating arm; and, a communication interface comprising an antenna tuning circuit connected to the first radiating arm, the antenna tuning circuit for independent tuning of each the first frequency band, the second frequency band and the third frequency band.

At least one of the second radiating arm and the third radiating arm are adapted to extend along the housing.

The first frequency band can comprise one or more of: about 5 GHz to about 6 GHz; and a WiFi a band; the second frequency band can comprise one or more of: about 2 GHz to about 2.5 GHz; a WiFi b,g band; and a Bluetooth™ band; and the third frequency band can comprise one or more of: about 1 GHz to about 2 GHz; a GPS (Global Positioning System) band; and a GLONASS (Globalnaya Navigatsionnaya Sputnikovaya Sistema) band.

Figure 2:
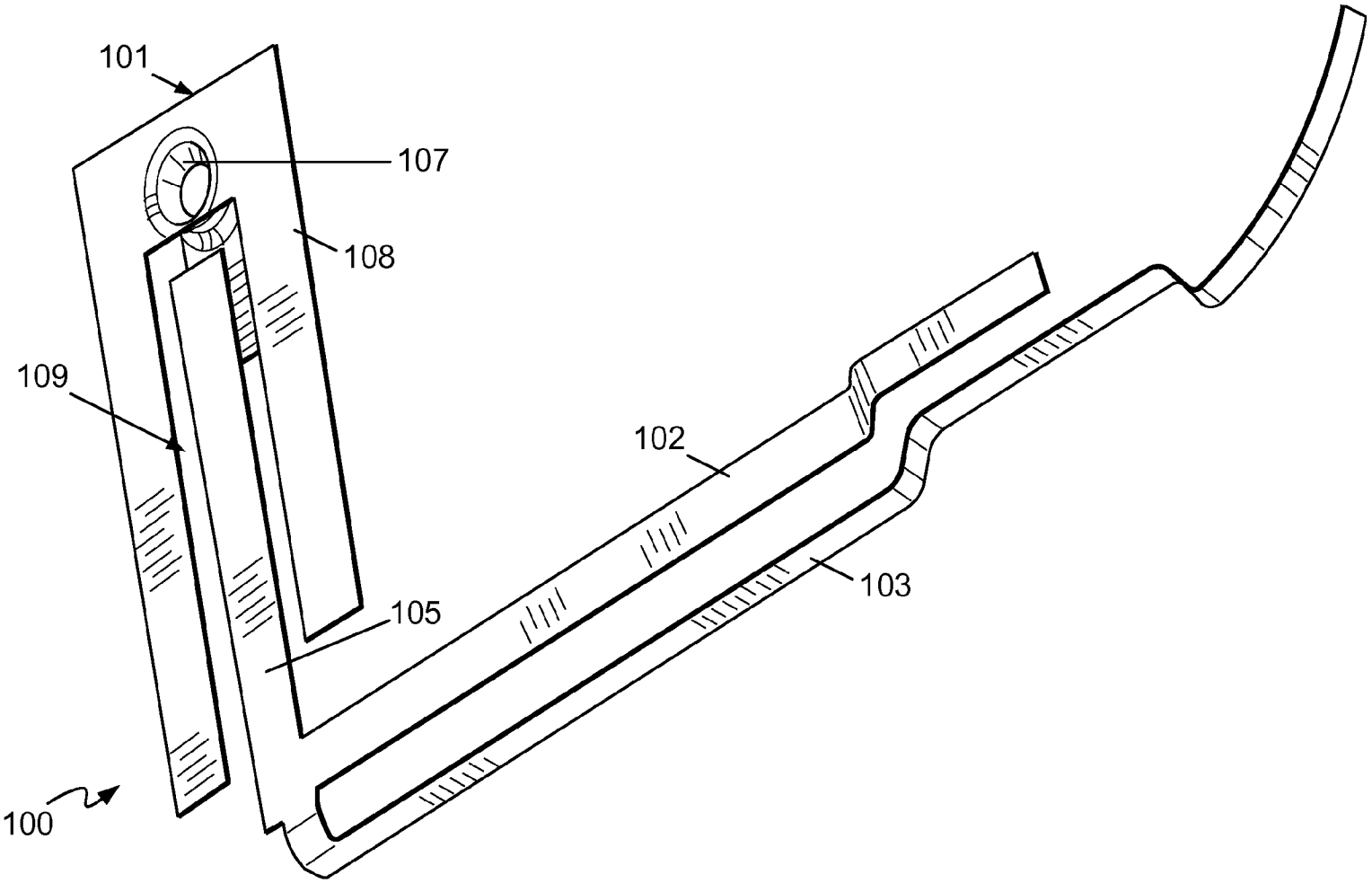
FIG. 2 depicts a front perspective view of the tri-band antenna of FIG. 1, according to non-limiting implementations.

FIGS. 1 and 2 respectively depict left and front perspective views of a tri-band antenna 100 comprising: a first radiating arm 101, a second radiating arm 102, a third radiating arm 103, and a coupling arm 105, according to non-limiting implementations. First radiating arm 101 is generally enabled for generating a first resonance in a first frequency band. First radiating arm 101 is further enabled for connection to an antenna feed 107; indeed, in depicted implementations, tri-band antenna 100 further comprises antenna feed 107 connected to first radiating arm 101. First radiating arm 101 further comprises a capacitive coupling structure 108: in other words, the shape of first radiating arm 101 is such that first radiating arm 101 can be capacitively coupled to coupling arm 105 and in turn capacitively coupled to second radiating arm 102 and third radiating arm 103. It is further appreciated that coupling arm 105 is hence separated by a gap 109 from the first radiating arm 101 such that the capacitive coupling occurs via gap 109. Second radiating arm 102 is generally enabled for generating a second resonance in a second frequency band lower than the first frequency band, second radiating arm 102 connected to coupling arm 105 such that second radiating arm 102 is capacitively coupled to first radiating arm 101. Third radiating arm 103 is generally enabled for generating a third resonance in a third frequency band lower than the second frequency band, third radiating arm 103 connected to coupling arm 105 such that third radiating arm 103 is capacitively coupled to first radiating arm 101.

Figure 3:
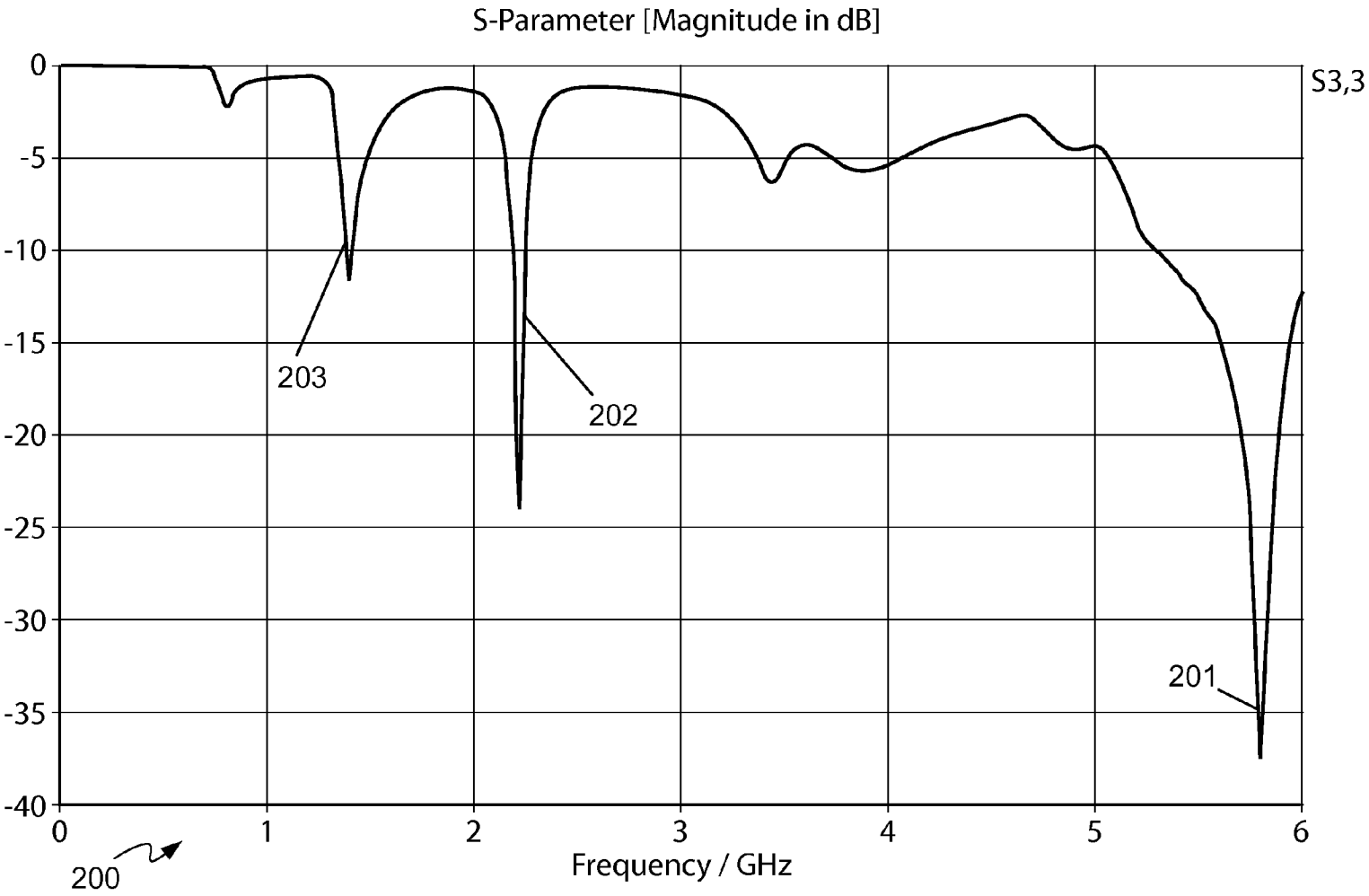
FIG. 3 depicts a graph of return loss characteristics of the tri-band antenna of FIG. 1, according to non-limiting implementations.

Attention is next directed to FIG. 3 which depicts a graph 200 showing a frequency response of tri-band antenna 100 according to non-limiting implementations. Specifically, graph 200 comprises return loss (i.e. S-parameter in decibels) of tri-band antenna 100 as a function of frequency (in Giga-Hertz (GHz)), return loss being a measure of the effectiveness of power delivery from a transmission line to tri-band antenna 100. For example, graph 200 depicts three peaks 201, 202, 203 respectively corresponding to the first frequency band of first radiating arm 101, the second frequency band of the second radiating arm 102 and the third frequency band of the third radiating arm 103. Specifically, first peak 201 (i.e. the first frequency band) is in the range of about 5 GHz to about 6 GHz, and further corresponds to a WiFi a, n band. Second peak 202 (i.e. the second frequency band) is in the range of about 2 GHz to about 2.5 GHzm and further corresponds to one or more of a WiFi b, g band and a Bluetooth™ band. Third peak 203 (i.e. the third frequency band) is an a range of about 1 GHz to about 2 GHz, and further corresponds to one of more of a GPS (Global Positioning System) band and a GLONASS (Globalnaya Navigatsionnaya Sputnikovaya Sistema) band.

Tri-band antenna 100 is therefore enabled for communicating in at least three different bands and on at least three different protocols. For example, tri-band antenna 100 can be used to communicate on the WiFi a,n band of 5.170 GHz to 5.835 GHz, the WiFi b,g and Bluetooth™ bands of 2.4 GHz to 2.5 GHz, as well as the GPS band of about 1.575 GHz and the GLONASS band of about 1.602 GHz. Hence, tri-band antenna 100 can replace a plurality of respective antennas for each of these bands in a mobile electronic device.

Figure 4:
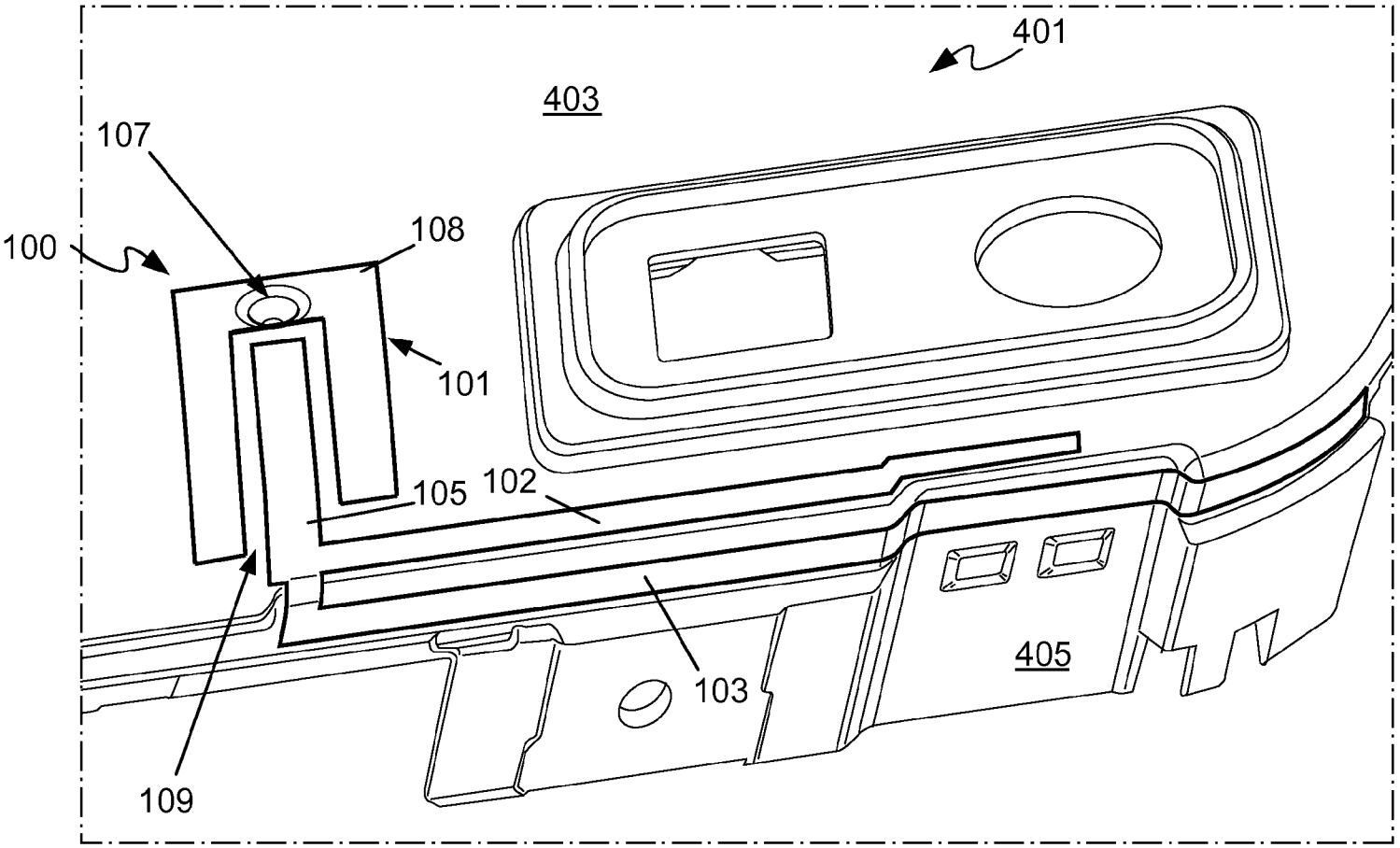
FIG. 4 depicts the tri-band antenna of FIG. 1 integrated into a housing, according to non-limiting implementations.

For example, attention is next directed to FIG. 4 which depicts tri-band antenna 100 integrated into a housing 401 of a mobile electronic device. It is appreciated that housing 401 can comprise an internal housing: for example, housing 401 can be internal to a mobile electronic device. From FIG. 4, it is appreciated that: first radiating arm 101 is located at a planar side 403 of housing 401, for example a back side; second radiating arm 102 extends along an edge of housing 401; and third radiating arm 103 extends along a sidewall 405 of housing 401. Further, each of second radiating arm 102 and third radiating arm 103 are adapted to extend along housing 401: for example, the depicted sidewall 405 comprises various physical contours, and both of second radiating arm 102 and third radiating arm 103 are contoured accordingly. The contours of second radiating arm 102 and third radiating arm 103 are also visible in FIGS. 1 and 2.

It is yet further appreciated that at least one of first radiating arm 101, second radiating arm 102 and third radiating arm 103 are located at a position at housing 401 to reduce combined SAR (specific absorption rate) at the mobile electronic device.

It is yet further appreciated from FIGS. 1, 2, and 3 that first radiating arm 101 and second radiating arm 102 are located in a same plane for example along planar side 403, and third radiating arm 103 is in another plane about perpendicular to the plane of that first radiating arm 101 and second radiating arm 102. In other words, a lateral axis of third radiating arm 103 is about perpendicular to a lateral axis of second radiating arm 102.

Figure 5:
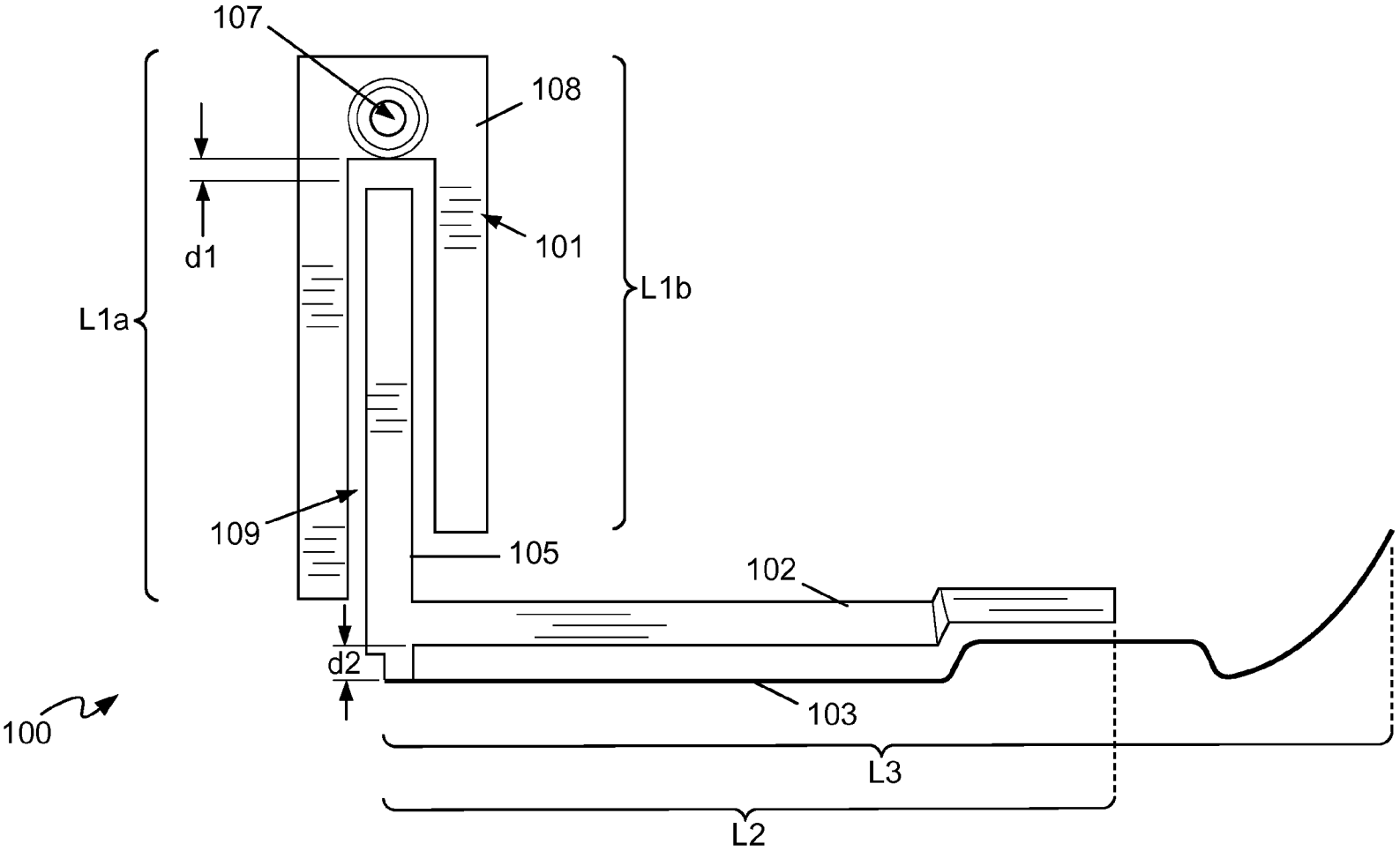
FIG. 5 depicts a top view of the tri-band antenna of FIG. 1, according to non-limiting implementations.

Attention is next directed to FIG. 5 which depicts a top view of tri-band antenna 100. From FIG. 5 it is appreciated capacitive coupling structure 108 of first radiating arm 101 comprises a planar structure. Further capacitive coupling structure 108 of first radiating arm 101 comprises a U-shaped capacitive coupling structure and coupling arm 105 extends between long arms of the U-shaped capacitive coupling structure.

From FIG. 5 it is further appreciated that second radiating arm 102 and third radiating arm 103 are about parallel, and further that second radiating arm 102 and third radiating arm 103 are about perpendicular to coupling arm 105.

FIG. 5 also indicates dimensions of first radiating arm 101, second radiating arm 102, third radiating arm 103, gap 109 and a gap between second radiating arm 102 and third radiating arm 103. Specifically, it is yet further appreciated that the "U" shape of capacitive coupling structure is not symmetrical, with one long side of the "U" having a length "L1*a*" which is longer than an opposite long side having a length "L1*b*". Specifically, "L2" indicates the length of second radiating arm 102, and "L3" indicates the length of third radiating arm 103. Further the distance between capacitive coupling structure 108 and coupling arm 105 (i.e. the size of gap 109) is indicated by "d1". Similarly, the distance between second radiating arm 102 and third radiating arm 103 is indicated by "d2".

It is further appreciated that gap 109 can be adjusted to change the capacitive coupling between first radiating arm 101 and coupling arm 105. For example, the capacitance between capacitive coupling structure 108 and coupling arm 105 is as follows: C~1/d1, where "C" is the capacitance and "d1" is the size of gap 109, as indicated in FIG. 5.

Figure 6:
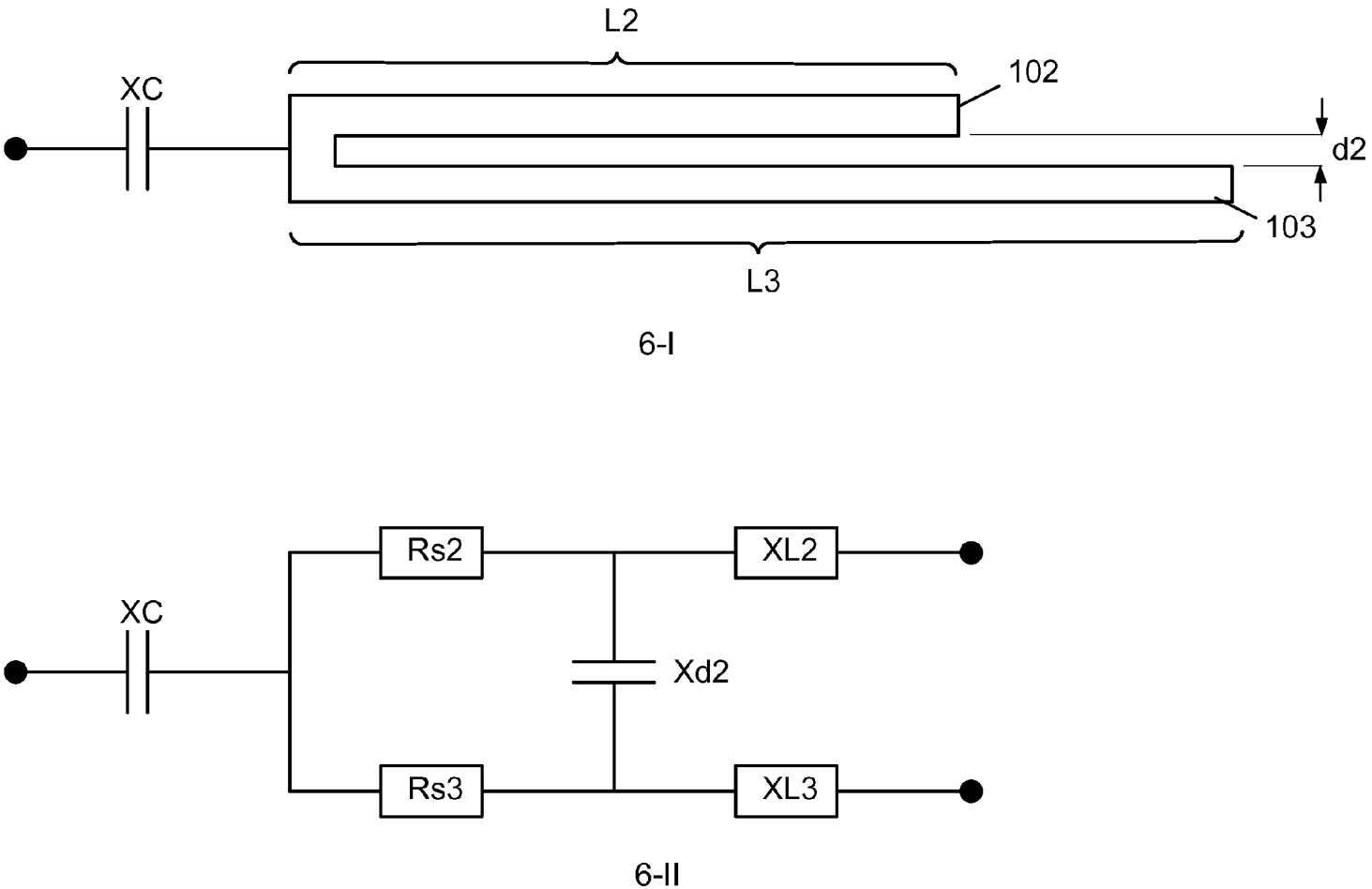
FIG. 6 depicts an electrical model of the tri-band antenna of FIG. 1 at a second and third frequency band, according to non-limiting implementations.

For example, attention is next directed to FIG. 6 which depicts an electrical model of second radiating arm 102 and third radiating arm 103 of tri-band antenna 100. Specifically, at 6-I of FIG. 6, second radiating arm 102 of length L2, and third radiating arm 103 of length L3 are shown electrically connected to a capacitive resistance XC, which is the capacitive resistance of gap 109. It is appreciated that capacitive resistance XC is in turn connected to antenna tuning circuit, and further that capacitive resistance XC is due to the capacitive feeding of second radiating arm 102 and third radiating arm 103. XC may be determined from XC=1/(ωC), where C is the capacitance of gap 109 and w is the frequency at which second radiating arm 102 and/or third radiating arm 103 are radiating (e.g. see FIG. 2).

FIG. 6 further depicts the equivalent circuit of second radiating arm 102 and third radiating arm 103 at 6-II. Specifically, second radiating arm 102 can be modelled as a radiation resistance Rs2 in series with an inductive resistance XL2; similarly, third radiating arm 103 can be modelled as a radiation resistance Rs3 in series with an inductive resistance XL3. The total resistance for each of second radiating arm 102 and third radiating arm 103 is hence, respectively, Rs2+XL2, and Rs3+XL3. Further, each inductive resistance XL2, XL3 in part compensates for capacitive resistance XC. Furthermore, coupling between second radiating arm 102 and third radiating arm 103 can be modelled as a capacitive resistance Xd2, indicating that coupling can be decreased by increasing d2.

Figure 7:
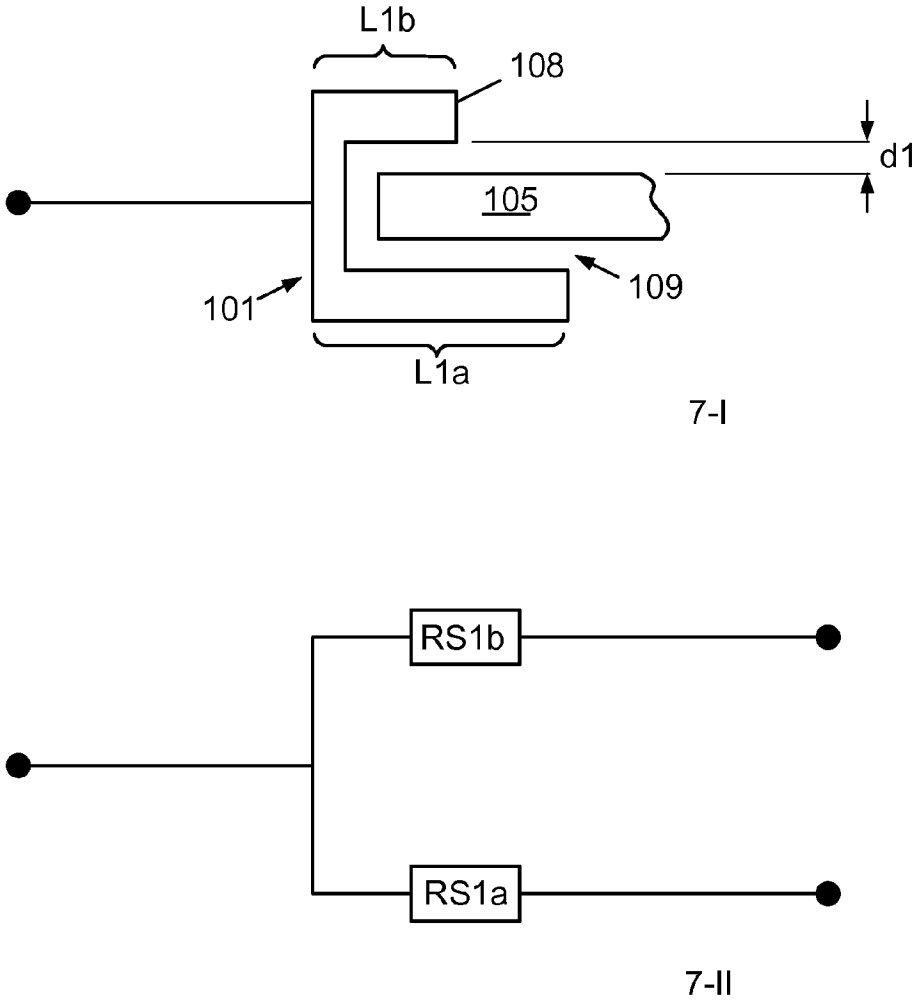
FIG. 7 depicts an electrical model of the tri-band antenna of FIG. 1 at a first frequency band higher than the second and third frequency bands, according to non-limiting implementations.

Attention is next directed to FIG. 7, which depicts an electrical model of first radiating arm 101 of tri-band antenna 100. Specifically, at 7-I it is appreciated that first radiating arm 101 is connected to the antenna tuning circuit without capacitive coupling. However, the long arms of capacitive coupling structure 108, having lengths L1*a*, L1*b*, are acting as part of an antenna radiator due to their electrical length (and not as part of the coupling structure). In other words, the coupling between capacitive coupling structure 108 and second radiating arm 102/third radiating arm 103 is not high in the frequency range of about 5 GHz to about 6 GHz such that that XC approaches 0. Rather the long arms of capacitive coupling structure 108 having lengths L1*a* and L1*ba* act as radiators when the mechanical length is in the range of ¼ the resonance wavelength. While second radiating arm 102 and third radiating arm 103 are still capacitively coupled to capacitive coupling structure 108 in the in the frequency range of about 5 GHz to about 6 GHz, the effect is minimal such the resonance of L1*a* and L1*b* is not affected in their respective frequency ranges.

Hence, the electrical model in FIG. 7 shows a respective radiation resistance, Rs1*a*, Rs1*b* of each of the long arms of capacitive coupling structure 108 having lengths L1*a* and L1*ba* connected in parallel. It is further appreciated that the radiation resistance, Rs1*a*, Rs1*b* of each of the long arms of capacitive coupling structure 108 having lengths L1*a* and L1*ba* are connected in parallel to an antenna tuning circuit. It is further assumed that any radiation resistance loss of capacitive coupling structure 108 is much less than either of radiation resistance, Rs1*a*, Rs1*b*, at least in the frequency range of about 5 GHz to about 6 GHz.

A successful prototype of tri-band antenna 100 is now described. In the successful prototype, with respect to first radiating arm 101, L1*a* was about 9.5 mm L1*b* was about 7.3 mm and d1 of gap 109 was about 0.5 mm. Furthermore, second radiating arm had a length L2 of about 18.5 mm, third radiating arm had a length L3 of about 26 mm, with a gap there between of d2 about 0.8 mm. Furthermore, a width of each of first radiating arm 101, second radiating arm 102 and third radiating arm 103 were each about 1.2 mm. In particular, the dimensions of the successful prototype are compatible with laser direct structuring techniques and were manufactured therewith.

Figure 8:
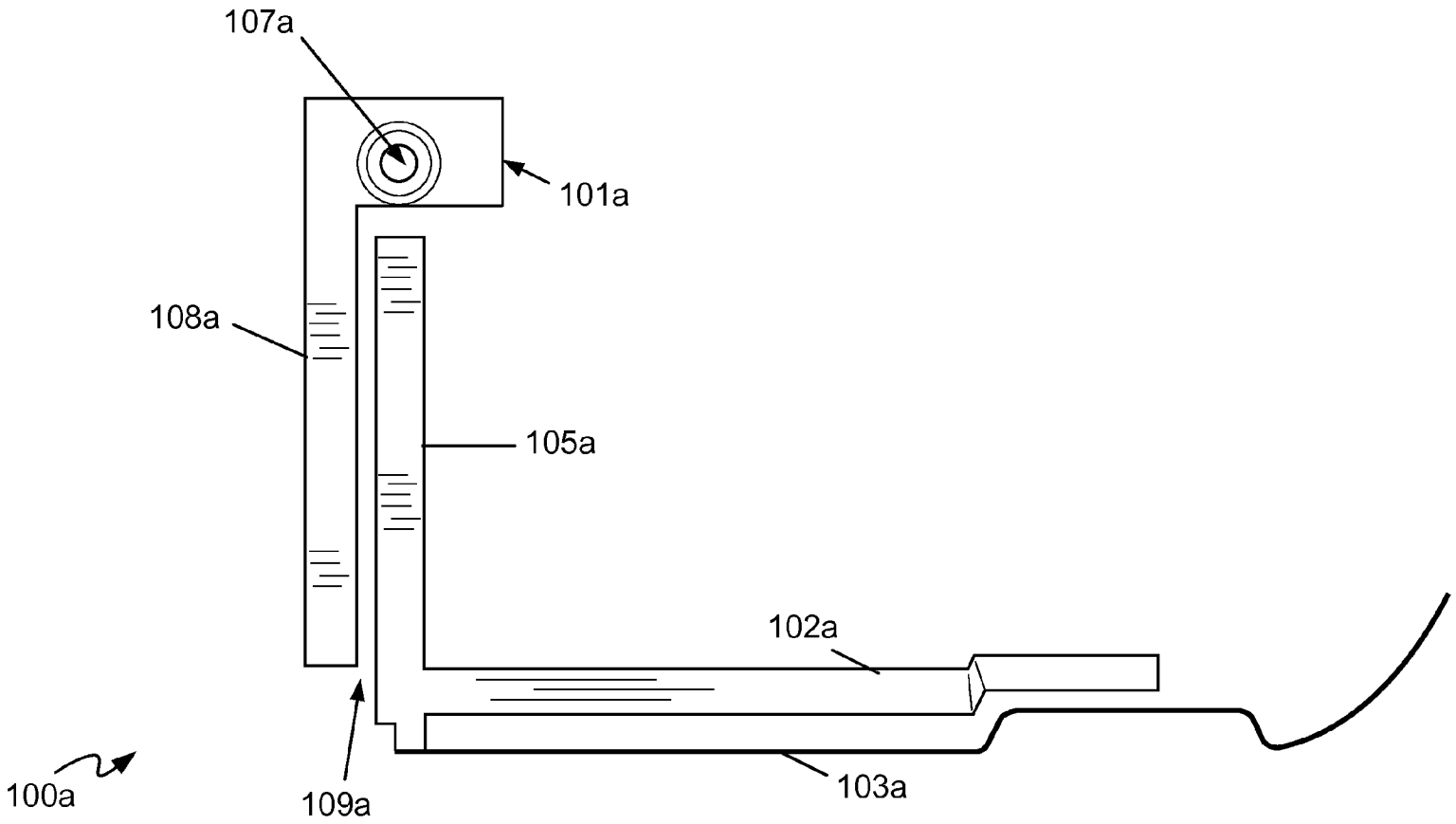
FIG. 8 depicts a top view of an alternative tri-band antenna, according to non-limiting implementations.

It is yet further appreciated that the shape of first radiating arm 101 is not limited to U-shaped capacitive coupling structures. For example, attention is next directed to FIG. 8 which depicts top view of an alternative tri-band antenna 100*a*, according to non-limiting implementations. Tri-band antenna 100*a* is substantially similar to tri-band antenna 100 with like elements having like numbers but with an "a" appended thereto. Hence, tri-band antenna 100*a* comprises a first radiating arm 101*a* comprising a capacitive coupling structure 108*a* capacitively coupled to a coupling arm 105*a*, which is in turn connected to a second radiating arm 102*a* and a third radiating arm 103*a*. First radiating arm 101*a* comprises an antenna feed 107*a*. Gap 109*a* separates first radiating arm 101*a* and coupling arm 105*a*. Hence, tri-band antenna 100*a* is substantially similar to tri-band antenna 100 except that capacitive coupling structure 108 of first radiating arm 101*a* comprises an L-shaped capacitive coupling structure and coupling arm 105*a* extends along a long arm of the L-shaped capacitive coupling structure and ends prior to a short arm of the L-shaped capacitive coupling structure. Gap 109*a* is adjusted relative to gap 109 to account for the change in capacitive coupling due to the change in capacitive coupling structure there between as described above.

Figure 9:
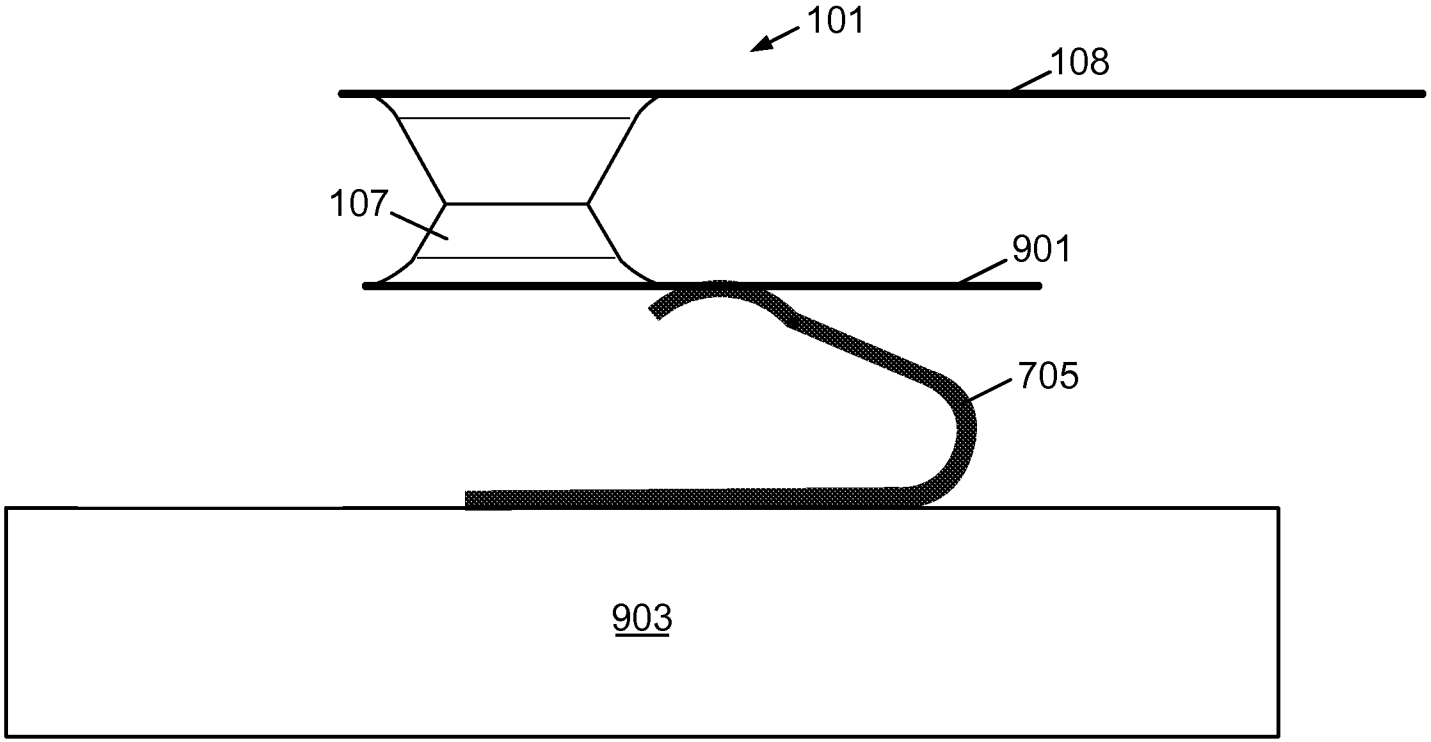
FIG. 9 depicts a side view of an antenna feed of the tri-band antenna of FIG. 1, according to non-limiting implementations.

Attention is next directed to FIG. 9, which depicts a side view of detail of first radiating arm 101 and antenna feed 107 when integrated into a mobile electronic device. Specifically, antenna feed 107 comprises a three dimensional feed extending from capacitive coupling structure 108 to a contact area 901, antenna feed 107 comprising contact area 901. Hence, antenna feed 107 is enabled to extend into a mobile electronic device to connect with an antenna tuning circuit 903; in depicted implementations, the connection between contact area 901 and antenna tuning circuit 903 comprises a biased flexible C-clip, however, in other implementations the connection can be made using any other suitable electrical connector. For example, antenna feed 107 need not be three-dimensional and a connection between capacitive coupling structure 108 and antenna tuning circuit 903 can comprise a conducting wire. However, the biased flexible C-clip 705 can be conveniently to obviate soldering the conducting wire to capacitive coupling structure 108 and antenna tuning circuit 903.

It is yet further appreciated that, in other implementations, antenna tuning circuit 903 and tri-band antenna 100 can be provided as an integrated unit. For example, tri-band antenna 100 can comprise antenna tuning circuit 903, wherein antenna tuning circuit 903 is enabled for independent tuning of each the first frequency band, the second frequency band and the third frequency band. Any suitable antenna tuning circuit 903 is within the scope of present implementations, but generally comprises an impedance matching circuit for matching first radiating arm 101, second radiating arm 102 and third radiating arm 103 to one or more radiators enabled to radiate in each of the first frequency band, the second frequency band and the third frequency band.

Figure 10:
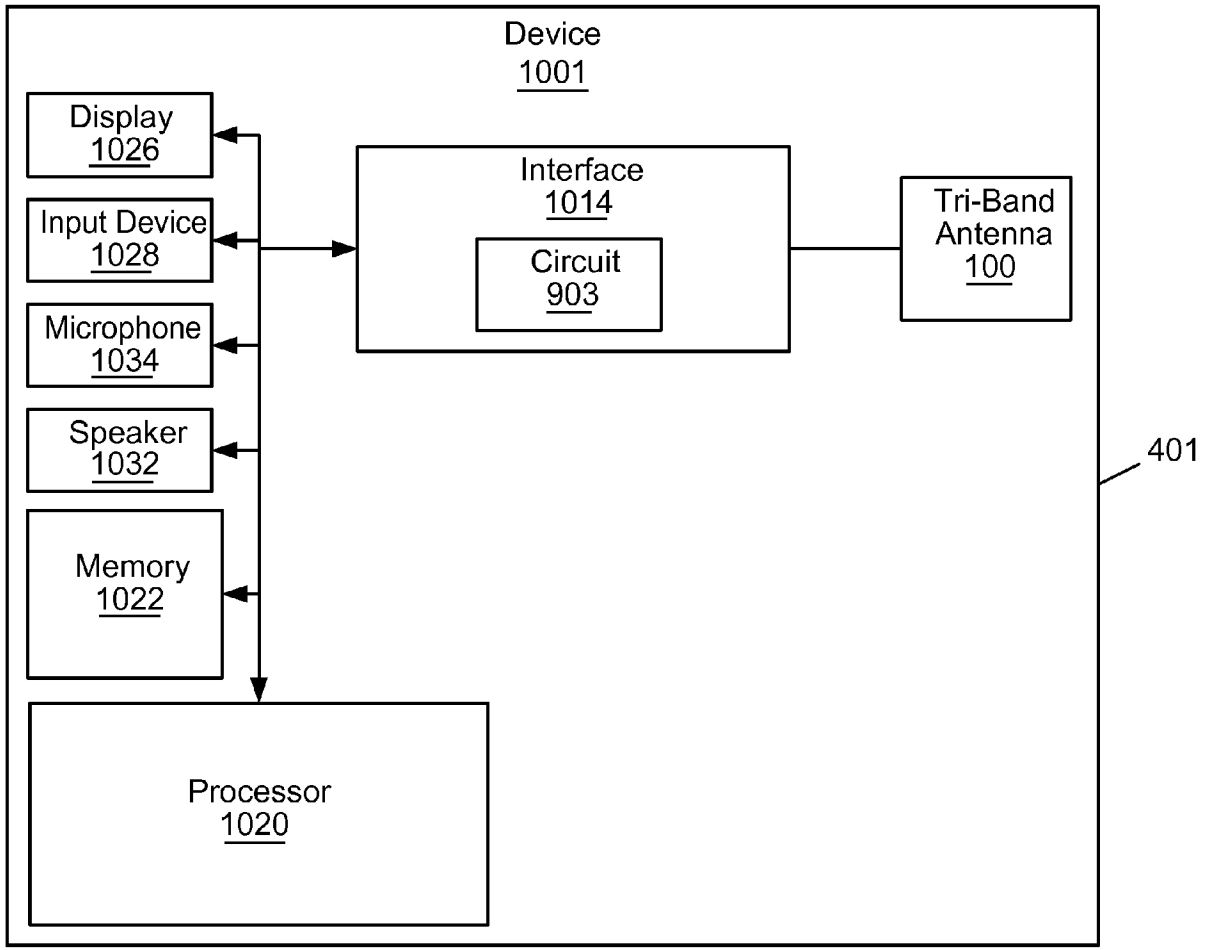
FIG. 10 depicts a schematic diagram of a device into which the tri-band antenna of FIG. 1 has been integrated, according to non-limiting implementations.

Attention is next directed to FIG. 10 which depicts a schematic diagram of a mobile electronic device 1001, referred to interchangeably hereafter as device 1001. Device 1001 comprises: housing 401 enabled to house components of device 1001; tri-band antenna 100; and a communication interface 1014 comprising antenna tuning circuit 903 connected to antenna feed 107 of tri-band antenna 100 as described above. As described above, in device 1001, at least one of second radiating arm 102 and third radiating arm 103 are adapted to extend along housing 401.

Device 1001 can be any type of electronic device that can be used in a self-contained manner to communicate with one or more communication networks using tri-band antenna 100. Device 1001 includes, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations.

It should be emphasized that the structure of device 1001 in FIG. 10 is purely an example, and contemplates a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

Device 1001 comprises at least one input device 1028 generally enabled to receive input data, and can comprise any suitable combination of input devices, including but not limited to a keyboard, a keypad, a pointing device, a mouse, a track wheel, a trackball, a touchpad, a touch screen and the like. Other suitable input devices are within the scope of present implementations.

Input from input device 1028 is received at processor 1020 (which can be implemented as a plurality of processors, including but not limited to one or more central processors (CPUs)). Processor 1020 is configured to communicate with a memory 1022 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 1001 as described herein are typically maintained, persistently, in memory 1022 and used by processor 1020 which makes appropriate utilization of volatile storage during the execution of such programming instructions. Those skilled in the art will now recognize that memory 1022 is an example of computer readable media that can store programming instructions executable on processor 1020. Furthermore, memory 1022 is also an example of a memory unit and/or memory module.

Processor 1020 can be further configured to communicate with display 1026, and microphone 134 and speaker 132. Display 1026 comprises any suitable one of, or combination of, CRT (cathode ray tube) and/or flat panel displays (e.g. LCD (liquid crystal display), plasma, OLED (organic light emitting diode), capacitive or resistive touchscreens, and the like). Microphone 134, comprises any suitable microphone for receiving sound data. Speaker 132 comprises any suitable speaker for providing sound data, audible alerts, audible communications from remote communication devices, and the like, at device 1001. In some implementations, input device 1028 and display 1026 are external to device 1001, with processor 1020 in communication with each of input device 1028 and display 1026 via a suitable connection and/or link.

Processor 1020 also connects to interface 1014, which can be implemented as one or more radios and/or connectors and/or network adaptors, configured to wirelessly communicate with one or more communication networks (not depicted) via tri-band antenna 100. It will be appreciated that interface 1014 is configured to correspond with network architecture that is used to implement one or more communication links to the one or more communication networks, including but not limited to any suitable combination of USB (universal serial bus) cables, serial cables, wireless links, cell-phone links, cellular network links (including but not limited to 2G, 2.5G, 3G, 4G+, UMTS (Universal Mobile Telecommunications System), CDMA (Code division multiple access), WCDMA (Wideband CDMA), FDD (frequency division duplexing), TDD (time division duplexing), TDD-LTE (TDD-Long Term Evolution), TD-SCDMA (Time Division Synchronous Code Division Multiple Access) and the like, wireless data, Bluetooth links, NFC (near field communication) links, WiFi links, WiMax links, packet based links, the Internet, analog networks, the PSTN (public switched telephone network), access points, and the like, and/or a combination.

Specifically, interface 1014 comprises radio equipment (i.e. a radio transmitter and/or radio receiver) for receiving and transmitting signals using tri-band antenna 100. It is further appreciated that interface 1014 comprises antenna tuning circuit 903 as described above.

It is yet further appreciated that device 1001 comprises a power source, not depicted, for example a battery or the like. In some implementations the power source can comprise a connection to a mains power supply and a power adaptor (e.g. and AC-to-DC (alternating current to direct current) adaptor).

It is yet further appreciated that device 1001 further comprises an outer housing which houses components of device 1001, including housing 403.

In any event, it should be understood that a wide variety of configurations for device 1001 are contemplated.

Figure 11:
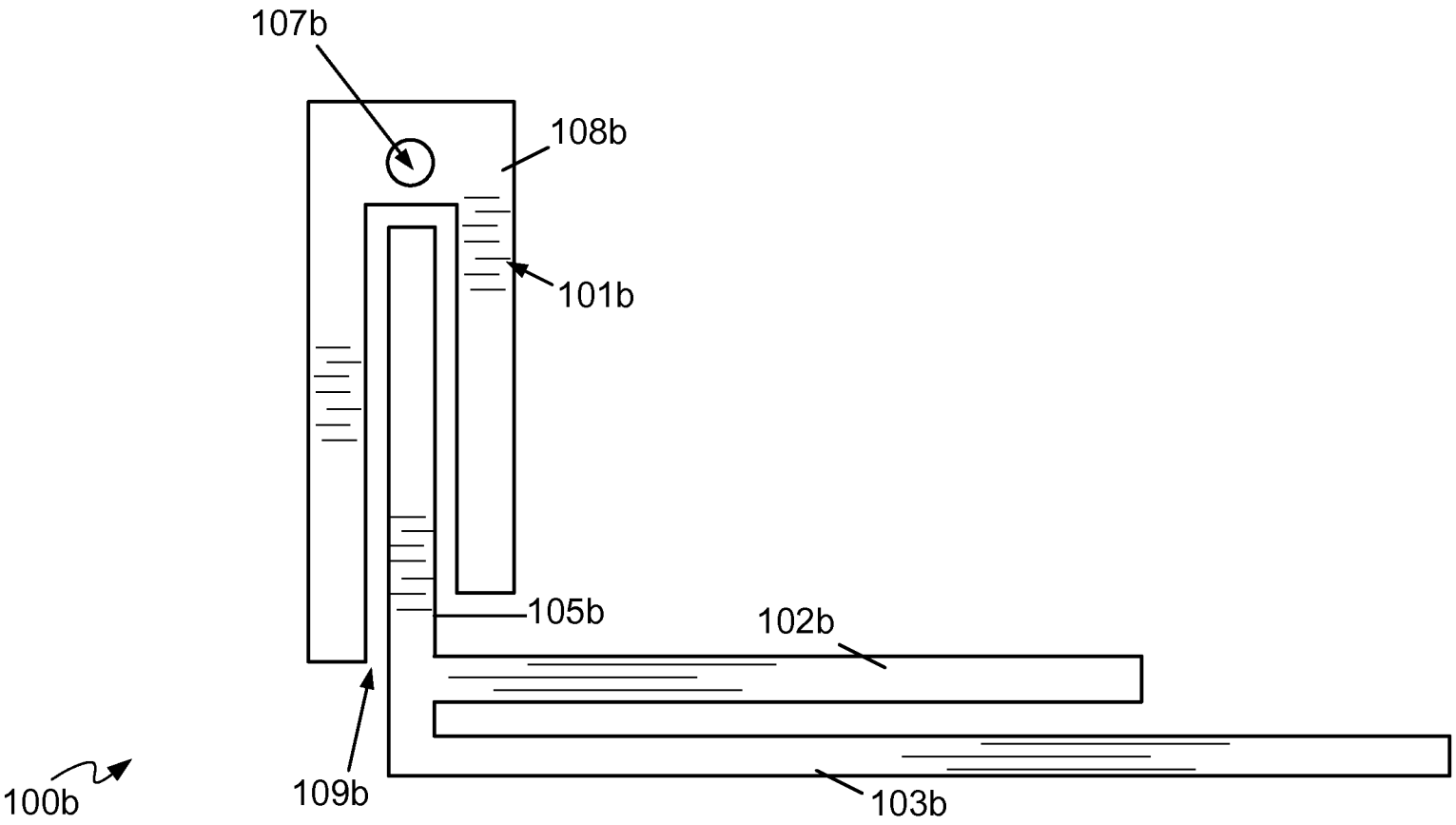
FIG. 11 depicts a top view of another alternative tri-band antenna, according to non-limiting implementations.

Persons skilled in the art will appreciate that there are yet more alternative implementations and modifications possible. For example, attention is next directed to FIG. 11 which depicts top view of an alternative tri-band antenna **100*b*, according to non-limiting implementations. Tri-band antenna 100*b* is substantially similar to tri-band antenna 100 with like elements having like numbers but with a "b" appended thereto. Hence, tri-band antenna 100*b* comprises a first radiating arm 101*b* comprising a U-shaped capacitive coupling structure 108*b* capacitively coupled to a coupling arm 105*b*, which is in turn connected to a second radiating arm 102*b* and a third radiating arm 103*b*. First radiating arm 101*b* comprises an antenna feed 107*b*. Gap 109*b* separates first radiating arm 101*b* and coupling arm 105*b*. However, while tri-band antenna 100*b* is substantially similar to tri-band antenna 100, each of second radiating arm 102*b* and third radiating arm 103*b* are in the same plane as first radiating arm 101**.

Figure 12:
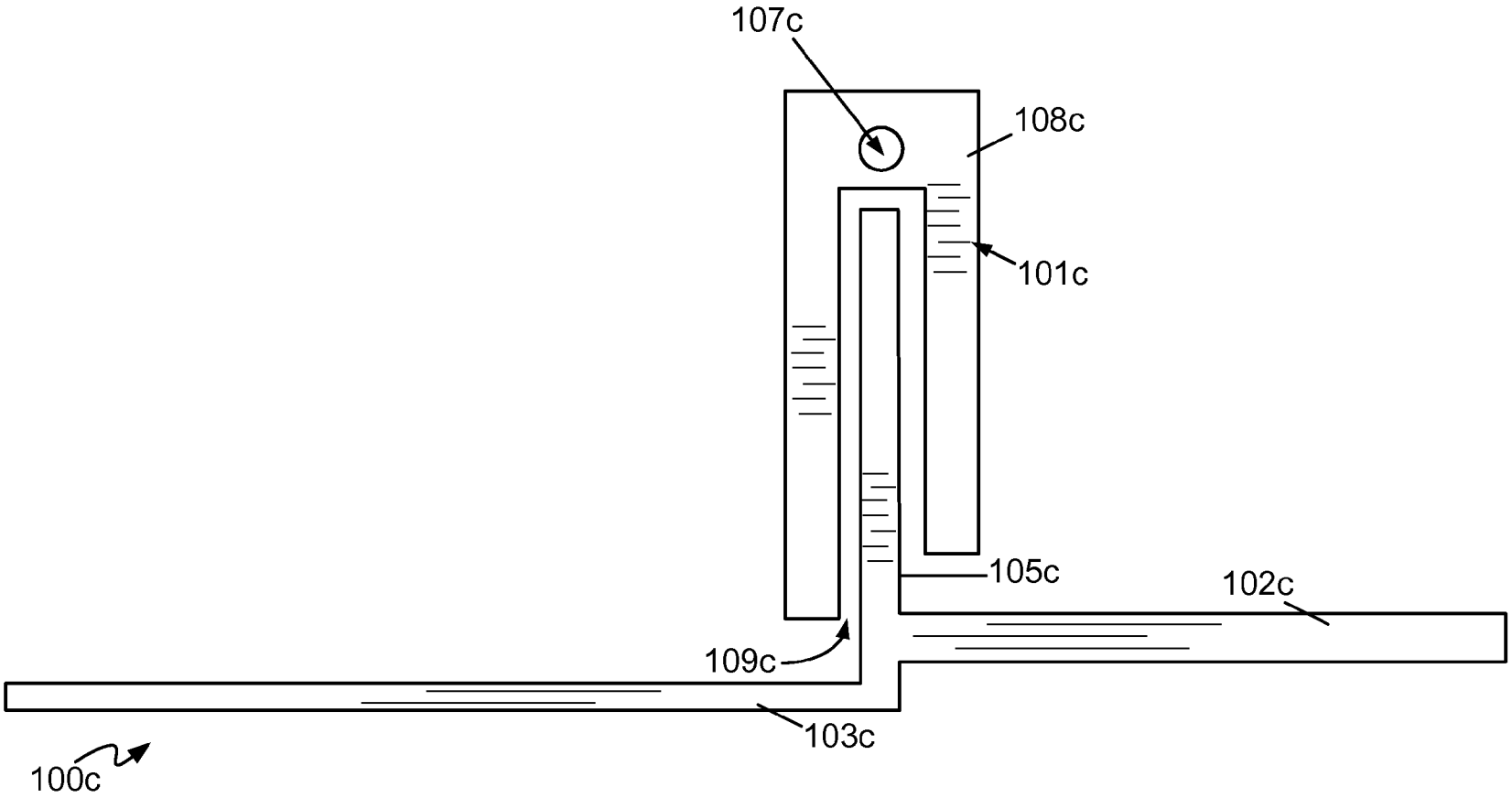
FIG. 12 depicts a top view of yet a further alternative tri-band antenna, according to non-limiting implementations.

Yet a further alternative tri-band antenna **100*c* is depicted in FIG. 12, according to non-limiting implementations. Tri-band antenna 100*c* is substantially similar to tri-band antenna 100*b* with like elements having like numbers but with a "c" appended thereto rather than a "b". Hence, tri-band antenna 100*c* comprises a first radiating arm 101*c* comprising a U-shaped capacitive coupling structure 108*c* capacitively coupled to a coupling arm 105*c*, which is in turn connected to a second radiating arm 102*c* and a third radiating arm 103*c*. First radiating arm 101*c* comprises an antenna feed 107*c*. Gap 109*c* separates first radiating arm 101*c* and coupling arm 105*c*. However, while tri-band antenna 100*c* is substantially similar to tri-band antenna 100***b*, second radiating arm 102*c* and third radiating arm 103*c* extend in opposite directions from coupling arm 105*c*.

In any event, a versatile tri-band antenna is described herein that can replace a plurality of antennas at a mobile electronic device. A first radiating arm radiating in a first band is connected to an antenna tuning circuit, and a second and third radiating arm radiating in respective second and third bands at frequencies less than the first band are capactively coupled to the antenna tuning circuit via the first radiating arm.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A tri-band antenna comprising:

a first radiating arm enabled for generating a first resonance in a first frequency band, the first radiating arm further enabled for connection to an antenna tuning circuit; the first radiating arm comprising a capacitive coupling structure;

a coupling arm separated by a gap from the first radiating arm, the gap being along at least two sides of the coupling arm;

a second radiating arm enabled for generating a second resonance in a second frequency band lower than the first frequency band, the second radiating arm connected to the coupling arm such that the second radiating arm is capacitively coupled to the first radiating arm; and a third radiating arm enabled for generating a third resonance in a third frequency band lower than the second frequency band, the third radiating arm connected to the coupling arm such that the third radiating arm is capacitively coupled to the first radiating arm, wherein: the coupling arm, the second radiating arm, and the third radiating arm are floating; and, each of the second radiating arm and the third radiating arm are respectively connected to the coupling arm only at one respective end so that each of the second radiating arm and the third radiating arm extends from the coupling arm.

2. The tri-band antenna of claim 1, wherein the first frequency band comprises one or more of:

about 5 GHz to about 6 GHz; and a WiFi a,n band.

3. The tri-band antenna of claim 1, wherein the second frequency band comprises one or more of:

about 2 GHz to about 2.5 GHz; and a WiFi b,g band;

a Bluetooth™ band.

4. The tri-band antenna of claim 1, wherein the third frequency band comprises one or more of:

about 1 GHz to about 2 GHz; and a GPS (Global Positioning System) band;

a GLONASS (Globalnaya Navigatsionnaya Sputnikovaya Sistema) band.

5. The tri-band antenna of claim 1, wherein the capacitive coupling structure comprises one of an L-shaped capacitive coupling structure and a U-shaped capacitive coupling structure.

6. The tri-band antenna of claim 5, wherein the coupling arm one of:

extends along a long arm of the L-shaped capacitive coupling structure and ends prior to a short arm of the L-shaped capacitive coupling structure; and, extends between long arms of the U-shaped capacitive coupling structure.

7. The tri-band antenna of claim 1, wherein the capacitive coupling structure comprises a planar structure.

8. The tri-band antenna of claim 1, wherein the first radiating arm comprises one or more of an antenna feed and a contact area for connecting to the antenna tuning circuit.

9. The tri-band antenna of claim 8, wherein the antenna feed comprises a three dimensional feed extending from the capacitive coupling structure to the contact area.

10. The tri-band antenna of claim 1, wherein at least one of the second radiating arm and the third radiating arm are adapted to extend along a housing of a mobile electronic device.

11. The tri-band antenna of claim 10, wherein at least one of the first radiating arm, the second radiating arm and the third radiating arm are located at a position at the housing to reduce combined SAR (specific absorption rate) at the mobile electronic device.

12. The tri-band antenna of claim 1, wherein the second radiating arm is in a same plane as the first radiating arm and the third radiating arm is in another plane about perpendicular to the same plane.

13. The tri-band antenna of claim 1, wherein the second radiating arm and the third radiating arm are parallel.

14. The tri-band antenna of claim 1, wherein the second radiating arm and the third radiating arm are perpendicular to the coupling arm.

15. The tri-band antenna of claim 1, wherein the second radiating arm and the third radiating arm extend in a same direction.

16. The tri-band antenna of claim 1, wherein the second radiating arm and the third radiating arm extend in opposite directions.

17. The tri-band antenna of claim 1, further comprising an antenna tuning circuit for independent tuning of each the first frequency band, the second frequency band and the third frequency band, the antenna tuning circuit connected to the antenna feed.

18. A device comprising:

a housing enabled to house components of the device;

a tri-band antenna comprising:

an antenna feed;

a first radiating arm enabled for generating a first resonance in a first frequency band; the first radiating arm comprising a capacitive coupling structure;

a coupling arm separated by a gap from the first radiating arm, the gap being along at least two sides of the coupling arm;

a second radiating arm enabled for generating a second resonance in a second frequency band lower than the first frequency band, the second radiating arm connected to the coupling arm such that the second radiating arm is capacitively coupled to the first radiating arm; and a third radiating arm enabled for generating a third resonance in a third frequency band lower than the second frequency band, the third radiating arm connected to the coupling arm such that the third radiating arm is capacitively coupled to the first radiating arm, wherein: the coupling arm, the second radiating arm, and the third radiating arm are floating; and, each of the second radiating arm and the third radiating arm are respectively connected to the coupling arm only at one respective end so that each of the second radiating arm and the third radiating arm extends from the coupling arm; and, a communication interface comprising an antenna tuning circuit connected to the first radiating arm, the antenna tuning circuit for independent tuning of each the first frequency band, the second frequency band and the third frequency band.

19. The device of claim 18, wherein at least one of the second radiating arm and the third radiating arm are adapted to extend along the housing.

20. The device of claim 18, wherein:

the first frequency band comprises one or more of: about 5 GHz to about 6 GHz; and a WiFi a band;

the second frequency band comprises one or more of: about 2 GHz to about 2.5 GHz; a WiFi b,g band; and a Bluetooth™ band; and the third frequency band comprises one or more of: about 1 GHz to about 2 GHz; a GPS (Global Positioning System) band; and a GLONASS (Globalnaya Navigatsionnaya Sputnikovaya Sistema) band.

* * * * *

UNITED STATES PATENT AND TRADEMARK OFFICE

CERTIFICATE OF CORRECTION

PATENT NO. : 8,988,288 B2
APPLICATION NO. : 13/547648
DATED : March 24, 2015
INVENTOR(S) : Andreas Handro, Michael Kuhn and Christopher Wehrmann It is certified that error appears in the above-identified patent and that said Letters Patent is hereby corrected as shown below:

In the Claims

Column 10, Line 41, In Claim 17, delete "each the" and insert -- each of the --, therefor.

Column 11, Lines 8-9, In Claim 18, delete "each the" and insert -- each of the --, therefor.

Signed and Sealed this
Eleventh Day of August, 2015

Michelle K. Lee

Michelle K. Lee
*Director of the United States Patent and Trademark Office*